US010808323B2

(12) United States Patent
Nardi et al.

(10) Patent No.: US 10,808,323 B2
(45) Date of Patent: Oct. 20, 2020

(54) COLD SPRAY NOZZLES

(71) Applicant: United Technologies Corporation, Farmington, CT (US)

(72) Inventors: Aaron T. Nardi, East Granby, CT (US); Michael A. Klecka, Vernon, CT (US); Louis Chiappetta, South Windsor, CT (US); Martin Haas, Columbia, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 8 days.

(21) Appl. No.: 16/131,481

(22) Filed: Sep. 14, 2018

(65) Prior Publication Data

US 2019/0010612 A1 Jan. 10, 2019

Related U.S. Application Data

(62) Division of application No. 14/934,976, filed on Nov. 6, 2015, now Pat. No. 10,100,412.

(60) Provisional application No. 62/076,272, filed on Nov. 6, 2014.

(51) Int. Cl.

| | |
|---|---|
| ***C23C 24/04*** | (2006.01) |
| ***B05B 7/14*** | (2006.01) |
| ***B05B 1/02*** | (2006.01) |
| ***B05B 7/16*** | (2006.01) |

(Continued)

(52) U.S. Cl.

CPC ..... *C23C 24/04* (2013.01); *B05B 1/02* (2013.01); *B05B 7/14* (2013.01); *B05B 7/1486* (2013.01); *B05B 7/1606* (2013.01); *B05B 7/0441* (2013.01); *B05B 7/1404* (2013.01); *C23C 4/02* (2013.01)

(58) Field of Classification Search

None

See application file for complete search history.

(56) References Cited

U.S. PATENT DOCUMENTS

2004/0166247 A1* 8/2004 Heinrich ..... B05B 7/0441 118/300

2005/0161532 A1 7/2005 Steenkiste et al.

(Continued)

FOREIGN PATENT DOCUMENTS

DE 10126100 A1 12/2002

DE 102009025473 A1 1/2011

(Continued)

OTHER PUBLICATIONS

English Abstract for DE10126100A1—Dec. 5, 2002; 1 pg.

(Continued)

*Primary Examiner* — Binu Thomas

(74) *Attorney, Agent, or Firm* — Cantor Colburn LLP

(57) ABSTRACT

A nozzle assembly for a cold spray deposition system includes a nozzle body with an axial bore. The axial bore defines a converging segment, a diverging segment downstream of the converging segment, and a throat fluidly connected between the converging and diverging segments of the axial bore. A particulate conduit is fixed within the axial bore and extends along the axial bore diverging segment for issuing solid particulate into the diverging segment of the axial bore.

10 Claims, 5 Drawing Sheets

(51) Int. Cl.
*C23C 4/02* (2006.01)
*B05B 7/04* (2006.01)

(56) References Cited

U.S. PATENT DOCUMENTS

2005/0211799 A1* 9/2005 Van Steenkiste ..... B05B 7/1486 239/416.5
2006/0201418 A1 9/2006 Ko et al.
2010/0108776 A1 5/2010 Esfahani et al.
2010/0330291 A1* 12/2010 Muggli ..... B05B 7/1486 118/313
2012/0193450 A1* 8/2012 Kay ..... B05B 7/1486 239/310
2012/0240852 A1 9/2012 Ewers
2013/0192519 A1* 8/2013 Kim ..... B05B 7/1486 118/50.1
2015/0300206 A1* 10/2015 Sultana ..... F01M 13/00 415/208.1
2016/0130703 A1 5/2016 Nardi et al.

FOREIGN PATENT DOCUMENTS

EP 2657368 A1 10/2013
FR 2997997 A1 5/2014
WO 2008098336 A1 8/2008

OTHER PUBLICATIONS

European Search Report for Application No. 15193523.6-1760; dated Mar. 9, 2016; 7 pgs.
English Machine Translation to Abstract DE102009025473.
English Machine Translation to Abstract FR2997997.
Harminder Singh et al, "Cold spray technology: Future of coating deposition processes"; Dated: Oct. 2012.
Opposition to Patent EP 3 017 874 B1 dated Apr. 4, 2019.

* cited by examiner

COLD SPRAY NOZZLES

CROSS REFERENCE TO RELATED APPLICATIONS

This application is a divisional application of U.S. patent application Ser. No. 14/934,976 filed on Nov. 6, 2015, which claims the benefit of U.S. Provisional Patent Application No. 62/076,272 filed on Nov. 6, 2014, the contents each of which are incorporated herein by reference thereto.

BACKGROUND

1. Field

The present disclosure relates to cold-gas dynamic spray deposition, and more particularly to nozzles for cold-gas dynamic spray deposition systems.

2. Description of Related Art

Cold-gas dynamic-spray processes, commonly referred to as 'cold spray', are deposition processes in which a jet of compressed carrier gas accelerates fine, solid powder materials toward a workpiece. The solid particles are typically metals, but can include polymers, ceramics, or metal composites. As the solid particles impact the workpiece surface the particles bond to the surface of the workpiece and form a deposition integral with the underlying workpiece. The prevailing theory for the mechanism by which the solid particles deform and bond during cold spray is that, during impact, the solid particles undergo plastic deformation. The deformation disrupts the thin, oxide surfaces and films of the solid particles and/or workpiece surface to achieve conformal contact between the solid particles and workpiece surface. Conformal contact of the solid particles in conjunction with the impact contact pressure impact promotes solid-state bonding of the solid particles and workpiece surface.

Cold spray nozzles typically accelerate solid particulate by directing a conveying motive gas entraining the solid particulate through a flow-restricting orifice. The gas undergoes a temperature reduction and pressure reduction while increasing velocity at it traverses the nozzle. This accelerates the entrained particulate to velocities sufficient to induce plastic deformation.

Such conventional methods and systems have generally been considered satisfactory for their intended purpose. However, there is still a need in the art for improved cold spray nozzles. The present disclosure provides a solution for this need.

SUMMARY OF THE DISCLOSURE

A nozzle assembly for a cold spray deposition system includes a nozzle body with an axial bore. The axial bore has a converging segment, a diverging segment, and a throat. The throat fluidly connects between the converging and diverging segments and the diverging segment is downstream of the throat. A particulate conduit fixed in the axial bore extends along the axial bore into the diverging segment for issuing solid particulate into the diverging segment.

In certain embodiments, the particulate conduit includes an inlet arranged on an upstream end and an outlet arranged on a downstream end in the diverging segment of the axial bore. The outlet can be arranged downstream in relation to the throat. The particulate conduit can have a substantially uniform flow area along lengths disposed within both the diverging and converging bore segments. The particulate conduit can be formed from a steel or ceramic material such as aluminum oxide material, or any other suitable material. The nozzle body can include a polymer material, a steel material, a carbide material, or any other suitable material.

In accordance with certain embodiments, the cold spray nozzle assembly includes a motive gas coupling. The motive gas coupling can connect the particulate conduit with a motive gas source such that a motive gas flow with entrained solid particulate traverses at least a portion of the axial bore within the particulate conduit. The motive gas coupling can be a first motive gas coupling, and a second motive gas coupling can connect to the converging segment of the axial bore for providing a second motive gas flow to the converging segment of the axial bore. It is contemplated that the particulate conduit limits (or eliminates) heat transfer between the second motive gas flow and the solid particulate, thereby allowing for higher second motive gas flow temperatures in the converging segment of the axial bore and commensurate higher solid particulate velocities in the diverging segment of the axial bore.

It is contemplated that, in accordance with certain embodiments, the cold spray nozzle includes an insert seated within the axial bore that fixes the particulate conduit within the axial bore. The insert can include a radially inner annulus, a radially outer annulus, and a plurality of ligaments extending radially between the radially inner annulus and the radially outer annulus. The plurality of ligaments can define a plurality of circumferentially spaced apart flow apertures therebetween circumferentially, each flow aperture having an axial profile conforming to the profile of the axial bore. The insert can be disposed within the converging or diverging segment of the axial bore. The insert can be one of a plurality of inserts disposed within the diverging segment, the converging segment, or both the converging and diverging segments of the axial bore.

A cold spray system includes a cold spray nozzle assembly as described above. The cold spray system includes a first motive gas source connected to the particulate conduit by a first motive gas coupling for supplying a first motive gas flow to the particulate conduit. A particulate source connects between the first motive gas source and the first motive gas coupling for introducing solid particulate into the first motive gas flow such that a first motive gas flow with entrained solid particulate can traverse a portion of the axial bore through the particulate conduit. A second motive gas flow source connects to the converging segment of the axial bore for providing a second motive gas to the axial bore, the second motive gas traversing the axial bore within an annular flow area defined about the particulate conduit exterior. This prevents intermixing of the first and second motive gases upstream of where the particulate conduit issues the first motive gas flow with entrained particulate into the second motive gas flow.

In certain embodiments, either or both of the first and second motive gas sources include nitrogen, helium, argon, or any other suitable motive gas. Each can include the same gas; each can include a different gas. The nozzle body can include a steel, cermet, carbide material, polymer material, or any other suitable material or combination of materials. The solid particle source can include aluminum or any other material suitable for cold spray deposition.

A method of cold spray includes receiving a first motive gas with entrained solid particulate at a particulate conduit fixed within an axial bore of a cold spray nozzle. The method also includes receiving a second motive gas within a converging segment of the axial bore. The method further includes directing the first motive gas with entrained solid particulate to a diverging segment of the axial bore through the particulate conduit. The method further includes directing the second motive gas to the diverging segment of the axial bore separately from the first motive gas with entrained particulate (i.e., independent from one another in terms of pressure, temperature, and velocity). The method further includes introducing the first motive gas with entrained solid particulate into the second motive gas flow within the diverging segment of the axial bore.

In certain embodiments, the method also includes increasing velocity of the second motive gas within the diverging segment upstream of a point for introducing the first motive gas with entrained solid particulate into the second motive gas. The method can also include cooling the particulate conduit using the first motive gas.

In one embodiment, a nozzle assembly for a cold spray system is provided. The nozzle assembly having: a nozzle body with an axial bore, the axial bore defining: a converging segment; a diverging segment downstream of the converging segment; a throat fluidly connected between the converging and diverging segments; and a particulate conduit fixed within the axial bore and extending along the axial bore into the diverging segment for issuing solid particles into the diverging segment of the axial bore.

In addition to one or more of the features described above, or as an alternative to any of the foregoing embodiments, the particulate conduit includes an outlet disposed in the diverging segment.

In addition to one or more of the features described above, or as an alternative to any of the foregoing embodiments, the particulate conduit defines a substantially uniform flow area within both the diverging and converging segments of the axial bore.

In addition to one or more of the features described above, or as an alternative to any of the foregoing embodiments, the nozzle body includes a steel material.

In addition to one or more of the features described above, or as an alternative to any of the foregoing embodiments, further embodiments may include a motive gas coupling connected to the particulate conduit.

In addition to one or more of the features described above, or as an alternative to any of the foregoing embodiments, the motive gas coupling is a first motive gas coupling, and further embodiment may include a second motive gas coupling connected to the converging segment of the axial bore.

In addition to one or more of the features described above, or as an alternative to any of the foregoing embodiments, further embodiments may include an insert seated within the axial bore and fixing the particulate conduit within the axial bore.

In addition to one or more of the features described above, or as an alternative to any of the foregoing embodiments, the insert may be seated within the converging segment of the axial bore.

In addition to one or more of the features described above, or as an alternative to any of the foregoing embodiments, the insert may include an annulus and a plurality ligaments, the annulus circumferentially surrounding the particulate conduit and the plurality of ligaments extending radially from the annulus.

In addition to one or more of the features described above, or as an alternative to any of the foregoing embodiments, the plurality of ligaments define circumferentially between one another a plurality of a motive gas flow aperture conforming to the profile of the axial bore.

In addition to one or more of the features described above, or as an alternative to any of the foregoing embodiments, the particulate conduit may have an exterior surface bounding a central portion of the axial bore.

In addition to one or more of the features described above, or as an alternative to any of the foregoing embodiments, the particulate conduit may include an exterior surface, wherein at least a portion of the exterior surface disposed within the converging segment includes thermal insulation.

In yet another embodiment, a cold spray system is provided. The system including: a nozzle assembly including a nozzle body with an axial bore, the axial bore defining: a converging segment; a diverging segment downstream of the converging segment; a throat fluidly connected between the converging and diverging segments; and a particulate conduit fixed within the axial bore and extending along the axial bore into the diverging segment; and a first motive gas coupling connected to the particulate conduit for supplying a first motive gas flow with entrained solid particulate to the diverging segment of the axial bore through the particulate conduit, a second motive gas coupling connected to the converging segment of the axial bore for supplying a second motive gas flow to diverging segment separated from the first motive gas flow with entrained solid particulate.

In addition to one or more of the features described above, or as an alternative to any of the foregoing embodiments, further embodiments may include a first motive gas source connected to the first motive gas coupling and a second motive gas source connected to the second motive gas coupling, wherein at least one of the first and second gas sources includes a gas selected from a group including nitrogen, helium and argon.

In addition to one or more of the features described above, or as an alternative to any of the foregoing embodiments, the first motive gas source may include a gas different than a gas included by the second motive gas source.

In addition to one or more of the features described above, or as an alternative to any of the foregoing embodiments, the first motive gas source and the second motive gas source are a common motive gas source.

In addition to one or more of the features described above, or as an alternative to any of the foregoing embodiments, the solid particulate includes aluminum, wherein the nozzle body includes a steel or carbide material.

In yet another embodiment, a method of cold spray deposition is provided, the method including the steps of: receiving a first motive gas with entrained solid particulate within a particulate conduit fixed within an axial bore of a cold spray nozzle; receiving a second motive gas within a converging segment of the axial bore; directing the first motive gas with entrained solid particulate to a diverging segment of the axial bore through the particulate conduit; directing the second motive gas to the diverging segment of the axial bore separately from the first motive gas with entrained solid particulate; and introducing the first motive gas with entrained solid particulate into the second motive gas in the diverging segment of the axial bore.

In addition to one or more of the features described above, or as an alternative to any of the foregoing embodiments, further embodiments may include increasing a velocity of the second motive gas within the diverging segment of the axial bore prior to introducing operation the first motive gas flow and entrained solid particulate into the second motive gas flow.

In addition to one or more of the features described above, or as an alternative to any of the foregoing embodiments, further embodiments may include cooling at least a portion of the particulate conduit disposed in the converging segment of the axial bore using the first motive gas.

In yet another embodiment, a method of making a cold spray nozzle is provided, the method including the steps of: determining at least one of a first motive gas flow parameter within a cold spray nozzle; determining an offset distance between an outlet of a particulate conduit and a throat of the cold spray nozzle using the determined first motive gas flow parameter; and positioning the particulate conduit axially within the nozzle such that the outlet is axially offset from the throat by the offset distance.

In addition to one or more of the features described above, or as an alternative to any of the foregoing embodiments, the offset distance positions the outlet in a converging segment of the cold spray nozzle.

In addition to one or more of the features described above, or as an alternative to any of the foregoing embodiments, the offset distance positions the outlet in a diverging segment of the cold spray nozzle.

In addition to one or more of the features described above, or as an alternative to any of the foregoing embodiments, the offset distance positions the outlet in a throat of the cold spray nozzle.

These and other features of the systems and methods of the subject disclosure will become more readily apparent to those skilled in the art from the following detailed description of the disclosed embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE DISCLOSURE

Figure 1:
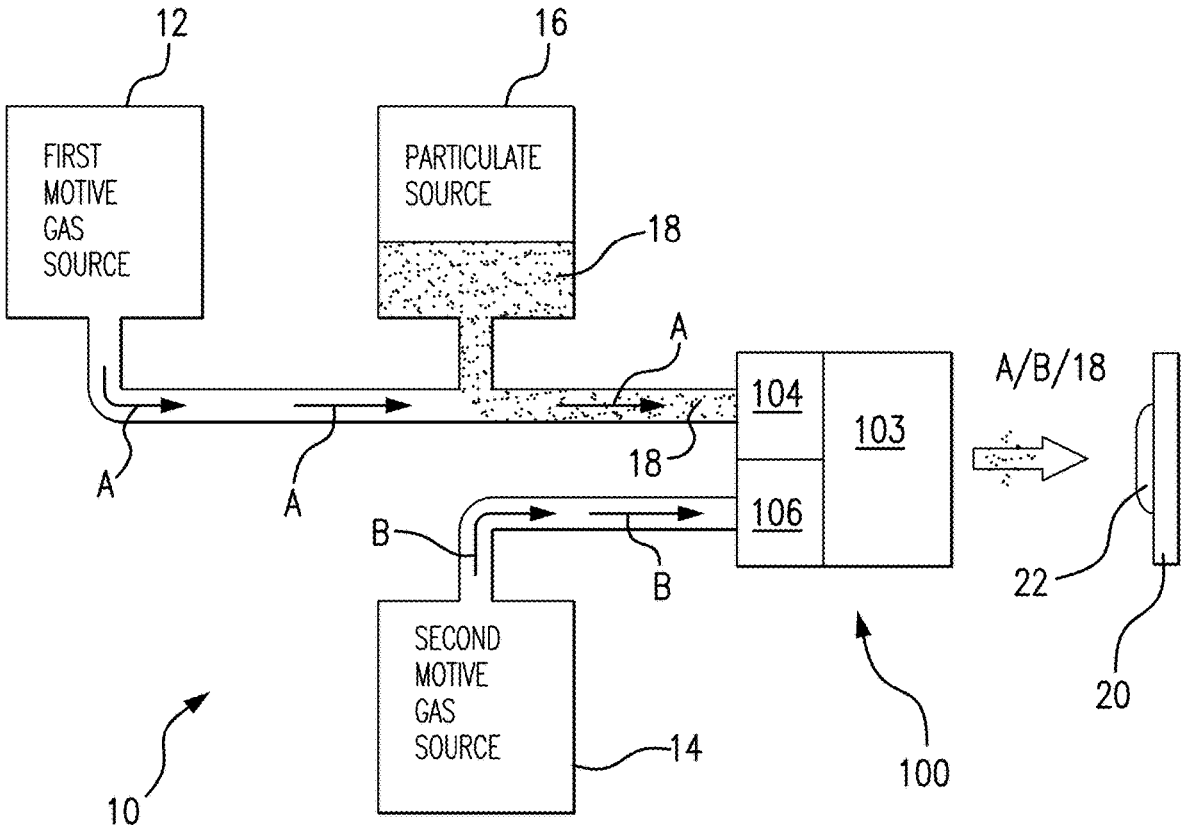
FIG. 1 is a schematic view of an exemplary embodiment of a cold spray system constructed in accordance with the present disclosure, showing a cold spray nozzle assembly.

Reference will now be made to the drawings wherein like reference numerals identify similar structural features or aspects of the subject disclosure. For purposes of explanation and illustration, and not limitation, a partial view of an exemplary embodiment of a cold spray nozzle assembly in accordance with the disclosure is shown in FIG. 1 and is designated generally by reference character 100. Other embodiments of cold spray nozzles, cold spray systems, and methods of cold spray deposition in accordance with the disclosure, or aspects thereof, are provided in FIGS. 2-4, as will be described. The systems and methods described herein can be used for cold gas dynamic spraying (e.g. cold spray), such as for developing depositions of solid particulate on gas turbine engine components.

As shown in FIG. 1, a cold spray deposition system 10 is shown schematically. Cold spray deposition system 10 includes a cold spray nozzle assembly 100, a first motive gas source 12, a second motive gas source 14, and a solid particulate source 16. Cold spray nozzle 100 includes a nozzle body 102 with a first motive gas coupling 104 and a second motive gas coupling 106. First motive gas coupling 104 connects first motive gas source 12 to nozzle body 102. Solid particulate source 16 connects between first motive gas source 12 and first motive gas coupling 104 thereby placing first motive gas source 12 and solid particulate source 16 in fluid communication with cold spray nozzle assembly 100. Second motive gas coupling 106 connects to second motive gas source 14 and places second motive gas source 14 in fluid communication with cold spray nozzle assembly 100.

First motive gas source 12 is configured and adapted to provide first motive gas flow A to cold spray nozzle assembly 100. Solid particulate source 16 introduces solid particulate 18 into first motive gas flow A. First motive gas flow A entrains the introduced solid particulate 18 and conveys the material to cold spray nozzle assembly 100 via first motive gas coupling 104. In embodiments, first motive gas flow A is an inert gas such as nitrogen, helium, argon, or any other gas suitable for conveying solid particulate 18.

Second motive gas source 14 is configured and adapted to provide a second motive gas flow B to cold spray nozzle assembly 100. Cold spray nozzle assembly 100 increases the velocity of second motive gas flow B as it traverses the assembly and prior to introducing first motive gas flow A with entrained solid particulate 18 into second motive gas flow B. Upon introduction, second motive gas flow B accelerates the solid particulate 18 such that solid particulate 18 issues from cold spray nozzle assembly 100 at velocities suitable for developing a deposition 22 on a target substrate 20 of predetermined quality (e.g. consistency). The issuing solid particulate 18 impacts target 20, bonds with a surface opposite cold spray nozzle assembly 100, and forms a deposition 22 on the surface.

Figure 2:
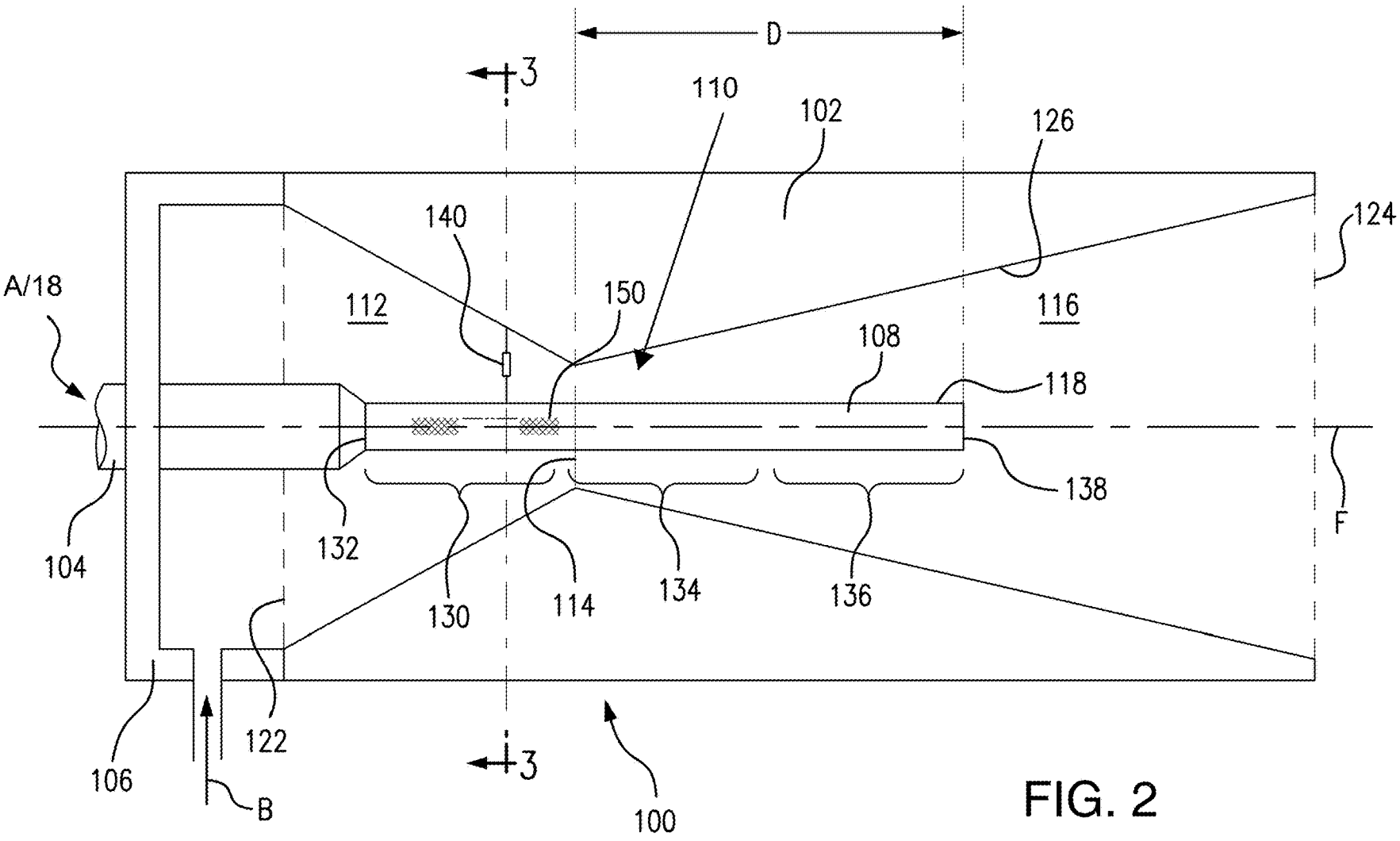
FIG. 2 is a schematic cross-sectional elevation view of the cold spray nozzle assembly of FIG. 1, showing a particulate conduit fixed within the cold spray nozzle assembly.

With reference to FIG. 2, cold spray nozzle assembly 100 is shown schematically. Cold spray nozzle assembly 100 is configured and adapted for receiving first motive gas flow A with entrained solid particulate 18 and second motive gas flow B. Cold spray nozzle assembly 100 is also configured and adapted for inducing first motive gas flow A with entrained solid particulate 18 at a point in the axial bore where second motive gas flow B has a predetermined pressure, temperature, and velocity different from that of second motive gas flow B at second motive gas flow coupling 106. In embodiments, cold spray nozzle assembly 100 is a converging-diverging nozzle. In certain embodiments, cold spray nozzle assembly is a de Laval nozzle constructed from steel, ceramic, cermet, a polymer material, or a combination thereof. It is contemplated that solid particulate 18 can be a material with a relatively low melting point, such as aluminum.

Cold spray nozzle assembly 100 includes nozzle body 102, a particulate conduit 108, and an insert 140 for fixing particulate conduit 108 within nozzle body 102. Nozzle body 102 defines within its interior an axial bore 110 extending along a particulate flow axis F. Axial bore 110 includes a converging segment 112, a throat 114, and a diverging segment 116. Converging segment 112 is connected to second motive gas coupling 106 and defines a progressively narrowing flow area extending between a relatively large flow area 122 to a relatively small flow area in throat 114, i.e., between upstream and downstream ends of converging segment 112. Diverging segment 116 is in fluid communication with converging segment 112 and is separated from converging segment 112 by throat 114. Throat 114 is fluidly connected between converging segment 112 and diverging segment 116. A flow area defined by diverging segment 116 progressively widens between throat 114 and a nozzle body outlet 124, i.e., between upstream and downstream ends of diverging segment 116.

Particulate conduit 108 is received within nozzle body 102 and extends along a portion of flow axis F. Particulate conduit 108 includes a first end 130 with an inlet 132, midsection 134, and a second end 136 with an outlet 138. First motive gas coupling 104 connects to first end 130 and is in fluid communication with inlet 132. Midsection 134 connects between first end 130 and second end 136, extends through throat 114, and connects inlet 132 in fluid communication with outlet 138. Particulate conduit 108 is disposed within axial bore 110 such that at least portion of first end 130 including inlet 132 is disposed within converging segment 112 and at least a portion of second end 136 including outlet 138 is disposed within diverging segment 116. In embodiments, particulate conduit 108 includes a steel or ceramic material. In certain embodiments, a thermal insulator 150 is disposed over at least a portion of particulate conduit 108 within converging segment 112. Thermal insulator coating 150 can be formed from a ceramic material, such as aluminum oxide for example. This can reduce heat transfer from second motive gas flow B into first motive gas flow A, potentially allowing for higher second motive gas flow B temperatures in converging segment 112 and commensurate higher solid particulate 18 velocities in diverging segment downstream of outlet 138 than possible with conventional nozzles. It is to be understood and appreciated that, in certain embodiments, particulate conduit 108 can be disposed within the axial bore such that output 138 is disposed within converging segment 112 of axial bore 104.

Figure 3:
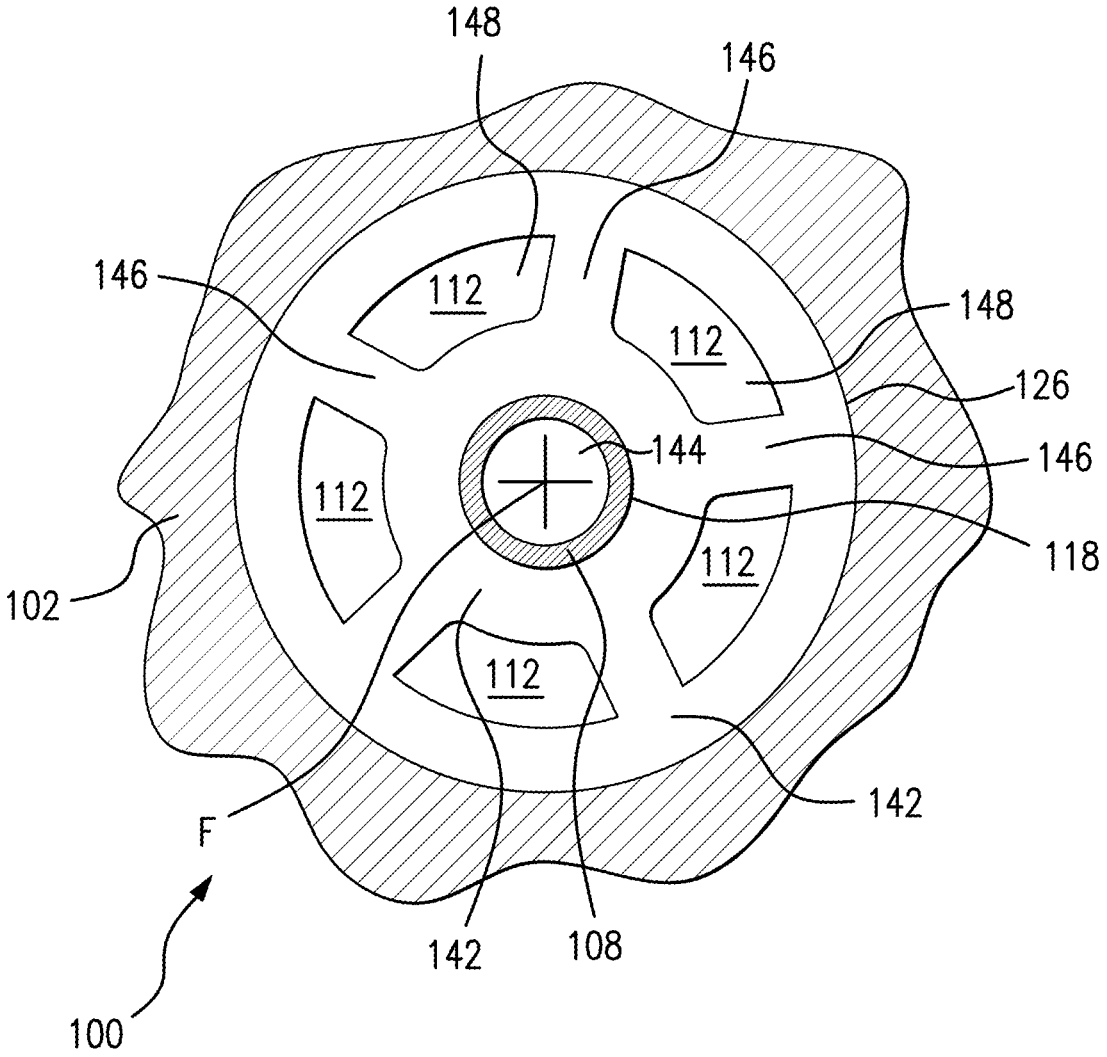
FIG. 3 is a cross-sectional end view taken along a flow axis of the cold spray nozzle shown in FIG. 1, showing an insert fixing a particulate conduit within the nozzle assembly.

With reference to FIG. 3, insert 140 is shown in an end view. Insert 140 seats within axial bore 110 and fixes particulate conduit 108 therein. In the illustrated embodiment a central annular portion 142 defines a central aperture 144 that surrounds an axially extending portion of particulate conduit surface 118. A plurality of radial ligaments 146 extend from central annular portion 142 and engage an interior surface 126 thereby fixing particulate conduit 108 within axial bore 110. Circumferentially adjacent radial ligaments 146 define between one another flow apertures 148. Insert flow apertures 148 allow second motive gas flow B to traverse insert 140 and are suitably shaped to allow pressure increase, temperature increase, and velocity of second motive gas flow B.

In certain embodiments, insert flow apertures 148 interrupt the otherwise progressive flow area reduction and the flow area of the nozzle within the converging segment of the nozzle. In this respect they interrupt the flow by presenting a relative abrupt reduction in flow area. However, by positioning insert 140 upstream of throat 114 such that the flow area of the apertures 148 is greater than that of throat 114, first motive gas flow A immediately thereafter enters a relatively larger flow area, and continues an otherwise orderly acceleration to throat 114. In embodiments, a plurality of inserts 140 seat within axial bore 110 and fix particulate conduit 108 therein. In certain embodiments, the plurality of inserts 140 are disposed only within converging segment 112. It is to be understood and appreciated that the plurality of inserts can be disposed only within diverging segment 116 or within both converging segment 112 and diverging segment 116, as suitable for an intended application. It is also to be understood and appreciated that, in accordance with certain embodiments, insert 140 can be disposed within throat 114.

Figure 4:
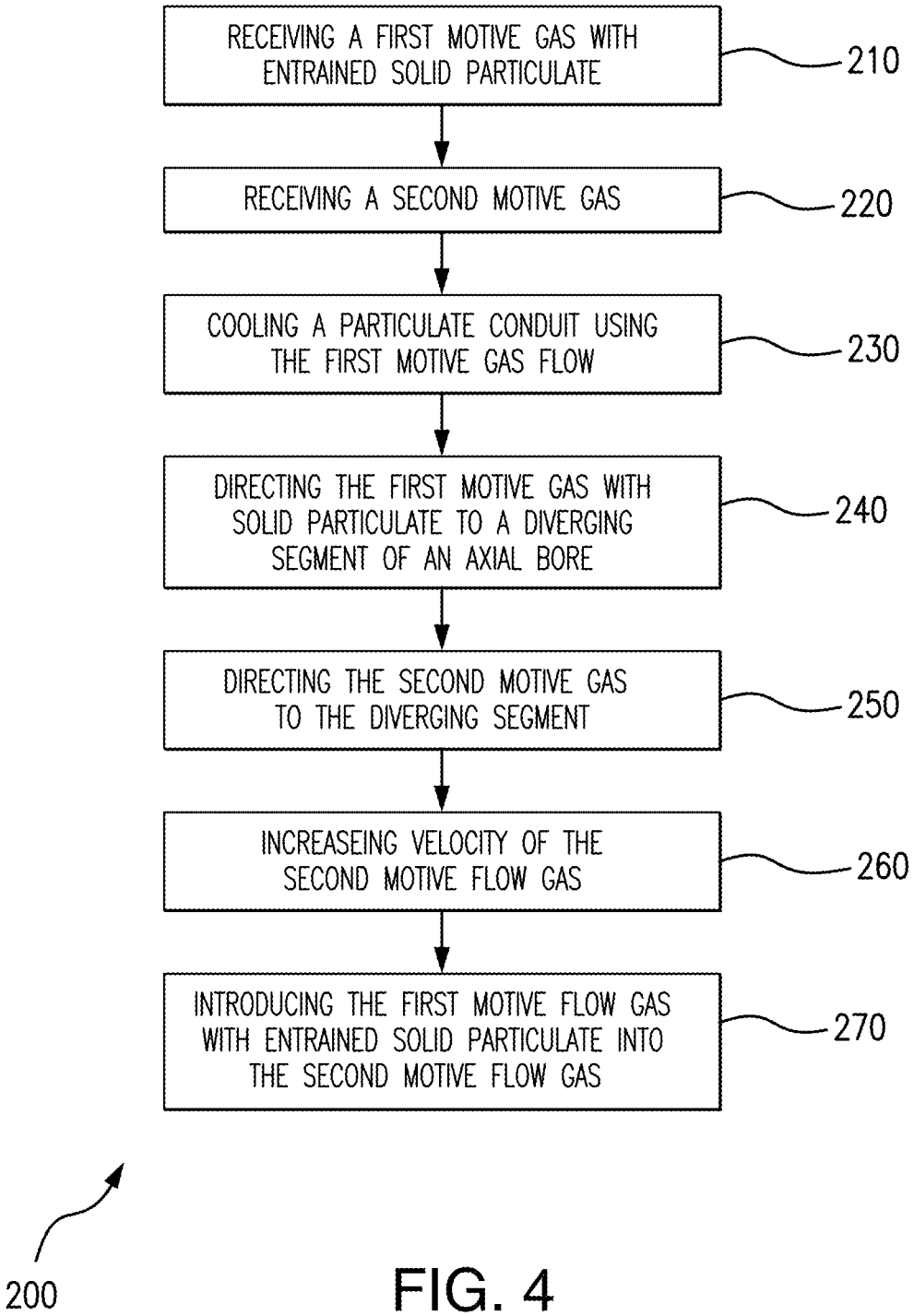
FIG. 4 is a process flow diagram of a method of cold spray deposition in accordance with the present disclosure, showing method operations.

With reference to FIG. 4, a cold spray method 200 is shown. As illustrated with a box 210, method 200 includes receiving a first motive gas with entrained solid particulate within a particulate conduit, e.g. particulate conduit 108, fixed within an axial bore, e.g., axial bore 110, of a cold spray nozzle, e.g. cold spray nozzle 100. Method 200 also includes receiving a second motive gas within a converging segment, e.g., converging segment of the axial bore 112, as illustrated with a box 220. In embodiments, only the first motive gas flow includes entrained solid particulate material. Method 200 further includes directing the first motive gas with entrained solid particulate to a diverging segment of the axial bore, e.g., diverging segment 116, as illustrated in a box 240. Method 250 additionally includes for directing the second motive gas to the diverging segment separately from the first motive gas with entrained particulate, as illustrated with a box 250. This allows for conveying the solid particulate through the converging segment of the nozzle without exposing the solid particulate to the temperature, pressure, and velocity changes included by the geometry of the converging segment of the nozzle.

Method 200 includes introducing the first motive gas with entrained solid particulate into the second motive gas flow in the diverging segment of the axial bore, as illustrated with a box 270. Optionally, method 200 can also include for increasing velocity of the second motive gas within the diverging segment prior to the introducing operation, as illustrated with a box 260. In certain embodiments, method 200 optionally includes cooling at least a portion of the particulate conduit disposed in the converging segment of the axial bore using the first motive gas, as illustrated with a box 230.

Figure 5:
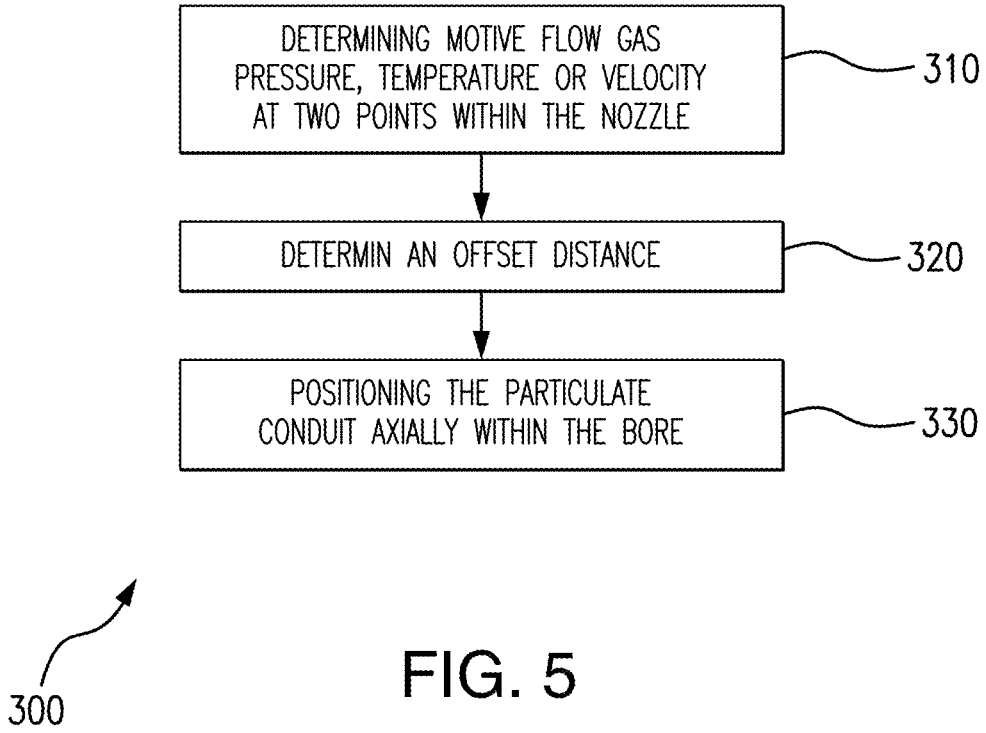
FIG. 5 is a process flow diagram of a method of making a nozzle for a cold spray deposition process.

With reference to FIG. 5, a method 300 of making a nozzle for a cold spray process, e.g., cold spray nozzle 100, is shown. As illustrated with a box 310, method 300 includes determining at least one of a first motive gas flow parameter, e.g., first motive gas flow A, within a cold spray nozzle, e.g. cold spray nozzle 100. Method 300 also includes determining an offset distance D (shown in FIG. 2) between an outlet of a particulate conduit in view of the determined first motive gas flow parameter, e.g., outlet 138, and a throat of the cold spray nozzle, e.g., throat 114, as illustrated with a box 320. Method 300 further includes positioning the particulate conduit axially within the nozzle such that the outlet is axially offset from the throat by the offset distance, as illustrated with a box 330.

In embodiments, offset distance D can be a negative value, indicating the outlet need be disposed upstream of the nozzle throat and within the converging portion of the nozzle to obtain a predetermined deposition characteristic. In certain embodiments, offset distance D can be a positive value, indicating the outlet need be disposed upstream of the nozzle throat and within the converging portion of the nozzle to obtain a predetermined deposition characteristic. It is also contemplated that offset distance D can be zero, indicated that the outlet need be disposed within the nozzle throat.

Cold spray deposition processes using materials like aluminum generally require nozzles constructed from plastic due to the tendency of the material to adhere to the nozzle surfaces defining the bore, potentially fouling the nozzle and disturbing the flow characteristics of the nozzle. While suitable for their intended purpose, such conventional cold spray nozzles can impose temperature limits on the motive gas used to convey the solid particulate through the nozzle. This can limit the velocity of solid particulate, potentially influencing the quality of the deposition developed by the cold spray nozzle. Introducing solid particulate into the converging segment of a conventional nozzle can enable the solid particulate to erode the inner surfaces of the nozzle. This can change flow characteristics of the nozzle and particulate issue velocity, potentially influencing the properties of the particulate deposition.

In embodiments, directing the first and second gases through the axial bore separately allows for changing the properties of the second motive gas according to the bore geometry without influencing the properties entrained solid particulate in the first motive gas flow. This potentially provides higher solid particulate velocities than ordinarily possible using a conventional nozzle.

In certain embodiments, directing the first motive gas with entrained solid particulate through the particulate conduit allows for the use of materials typically not included in conventional cold spray nozzles. For example, since certain types of solid particulate, e.g., aluminum, tend to adhere to steel or carbide surfaces nozzle interior surfaces, flow surfaces within conventional cold spray nozzles typically include a polymer material bounding the nozzle flow path. Directing the first motive gas with entrained particles through the particulate conduit separates the solid particulate from the nozzle body, thereby limiting contact between the solid particulate and nozzle flow path boundary surfaces. This reduces the likelihood of fouling within the cold spray nozzle. For similar reasons, use of the particulate conduit also reduces the tendency of the solid particulate to erode the nozzle interior surfaces.

Analysis by the Applicants indicates that solid particulate injected along the axial bore axis in the diverging segment, in embodiments, will not significantly impact the walls. This could prevent fouling of a steel nozzle in the diverging segment where intermixing the first and second gas flows would ordinarily suggest solid particulate would contact the nozzle flow surfaces, for example. In embodiments, this potentially allows for running the cold spray nozzle with temperatures exceeding 800 degrees Celsius (about 1500 degrees Fahrenheit) as solid particulate issues from the particulate conduit into the diverging segment at region where the second motive gas flow has cooled to about 500 degree Celsius (about 900 degrees Fahrenheit). It is contemplated that, in accordance with certain embodiments, the cold spray nozzle could have a plastic end portion coupled to metal, cermet, or ceramic nozzle body portion to further reduce the likelihood of fouling in the diverging segment of the axial bore.

The methods and systems of the present disclosure, as described above and shown in the drawings, provide for cold spray deposition nozzles, systems and methods with superior properties including increased issue velocity. While the apparatus and methods of the subject disclosure have been shown and described with reference to the disclosed embodiments, those skilled in the art will readily appreciate that changes and/or modifications may be made thereto without departing from the scope of the subject disclosure.

What is claimed is:

1. A nozzle assembly for a cold spray system, comprising:

a nozzle body with an axial bore, the axial bore defining:

a converging segment having a progressively narrowing flow area;

a diverging segment downstream of the converging segment;

a throat fluidly connected between the converging and diverging segments;

a particulate conduit fixed within the axial bore by an insert located in the narrowing flow area of the converging segment, the particulate conduit extending along the axial bore into the diverging segment for issuing solid particles into the diverging segment of the axial bore; and wherein the insert has a plurality of flow apertures that interrupt the narrowing flow area of the converging segment of the nozzle assembly.

2. An assembly as recited in claim 1, wherein the particulate conduit includes an outlet disposed in the diverging segment.

3. An assembly as recited in claim 2, wherein the particulate conduit defines a substantially uniform flow area within both the diverging and converging segments of the axial bore.

4. An assembly as recited in claim 1, wherein the nozzle body includes a steel material.

5. An assembly as recited in claim 1, further including a motive gas coupling connected to the particulate conduit.

6. An assembly as recited in claim 5, wherein the motive gas coupling is a first motive gas coupling, and further including a second motive gas coupling connected to the converging segment of the axial bore.

7. An assembly as recited in claim 1, wherein the insert includes an annulus and a plurality ligaments, the annulus circumferentially surrounding the particulate conduit and the plurality of ligaments extending radially from the annulus.

8. An assembly as recited in claim 7, wherein the plurality of ligaments define circumferentially between one another a plurality of a motive gas flow apertures conforming to the profile of the axial bore.

9. An assembly as recited in claim 1, wherein the particulate conduit has an exterior surface bounding a central portion of the axial bore.

10. An assembly as recited in claim 1, wherein the particulate conduit includes an exterior surface, wherein at least a portion of the exterior surface disposed within the converging segment includes thermal insulation.

* * * * *